United States Patent [19]

Cuche et al.

[11] 4,320,635

[45] Mar. 23, 1982

[54] ELECTROMAGNETIC SELECTION DEVICE FOR NEEDLES OF A KNITTING MACHINE

[75] Inventors: Claude Cuche, Corcelles; Rene Jeanneret, Motiers; Michel Niederhauser, Fleurier, all of Switzerland

[73] Assignee: Edouard Dubied & Cie. Societe Anonyme, Couvet, Switzerland

[21] Appl. No.: 44,997

[22] Filed: Jun. 4, 1979

[30] Foreign Application Priority Data

Jun. 5, 1978 [CH] Switzerland ..... 6115/78

[51] Int. Cl.[3] ..... D04B 15/78; D04B 15/70

[52] U.S. Cl. ..... 66/220; 66/75.2; 335/302

[58] Field of Search ..... 66/219, 220, 221, 75.2; 335/217, 302 (U.S. only)

[56] References Cited

U.S. PATENT DOCUMENTS

| | | | |
|---|---|---|---|
| 3,472,287 | 10/1969 | Ribler | 66/75.2 X |
| 3,488,639 | 1/1970 | Stein | 335/302 X |
| 3,861,173 | 1/1975 | Kinkelin | 66/220 |
| 3,863,465 | 2/1975 | De Cerjat et al. | 66/219 |
| 4,171,628 | 10/1979 | Ebner | 66/219 |

FOREIGN PATENT DOCUMENTS

| | | | |
|---|---|---|---|
| 1563200 | 3/1969 | France | 66/219 |
| 1187911 | 4/1970 | United Kingdom | 66/220 |

*Primary Examiner*—Wm. Carter Reynolds
*Attorney, Agent, or Firm*—Lewis H. Eslinger

[57] ABSTRACT

The device includes a canal having a narrowing entry and a widening outlet, separated by the poles of a pair of opposing electromagnets, and in which selective means, or selectors, are shifted. Two substantially identical, geometrically and magnetically symmetrical selector stations are provided. The entry and the outlet of the canal include a magnetic adherance system, functioning alternately as a stabilizer and as an amplifier of movement, following the direction of the device shifting in relation to the selectors to be selected.

5 Claims, 4 Drawing Figures

ELECTROMAGNETIC SELECTION DEVICE FOR NEEDLES OF A KNITTING MACHINE

BACKGROUND OF THE INVENTION

This invention relates to an electromagnetic selection device and, more particularly, to such a device for use with the needles of a knitting machine.

An electromagnetic selection device has been proposed, as suggested in U.S. Pat. No. 3,863,465, with a narrowing entry, a pair of opposing electromagnets, and a widening outlet. Selectable means, commonly referred to as selectors, magnetically adhere against the sides of such outlet. The magnetic adherence of the selectors is achieved by parts made of soft iron, associated with two permanent ferrite magnets located on both sides of a so-called selection canal, henceforth merely called the canal.

Although the proposed device appears to be satisfactory from a theoretical point of view, it is probable that, while in use, it might result in selection errors. The sizing of the ferrites, limited by problems of blocking up the selective device, does not guarantee the magnetic saturation of all selectors. Thus, when the same selectors, following at a short distance, are very unevenly distributed between the two sides of the canal, the magnetic field can be thrown out of balance and the adherence of the selector, then arriving on the proper side of the canal, cannot be ensured.

Another device of this kind, having a widening outlet, has its sides partially formed by two pole parts of opposing polarities and linked to a single permanent magnet. Pole parts of the same polarity are linked to one another by a magnetically permeable element, and pole parts of opposing polarities are separated by non-magnetic hard metal parts, resulting in differential magnetic adherence. Although this device is satisfactory, it presents substantial manufacturing drawbacks. For example, locating the exciting coil of the selection poles on a single core branch, besides being very complicated and having several gaps, creates a complex magnetic circuit having flux leakages which result in an assymetric selection flux for the selectors. Furthermore, the mechanical and magnetic tolerances of this device require the manufacturer to provide exact castings of each part in order to guarantee good performance of the device, even at high service temperatures due to the thermal dissipation of the electromagnet.

OBJECTS AND SUMMARY OF THE INVENTION

The object of this invention is to provide a simple selective device, serviceable on flat bed knitting machines as well as on circular knitting machines, which is easily manufactured and assembled, with no specific precautions. The selective device eliminates, in substantial proportions, the flux leakages near the selection poles, and also eliminates the drawbacks of the above mentioned devices.

Other objects, advantages and features of this invention will become apparent from the ensuing description, and the novel features will be particularly pointed out in the appended claims.

DETAILED DESCRIPTION

Figure 1:
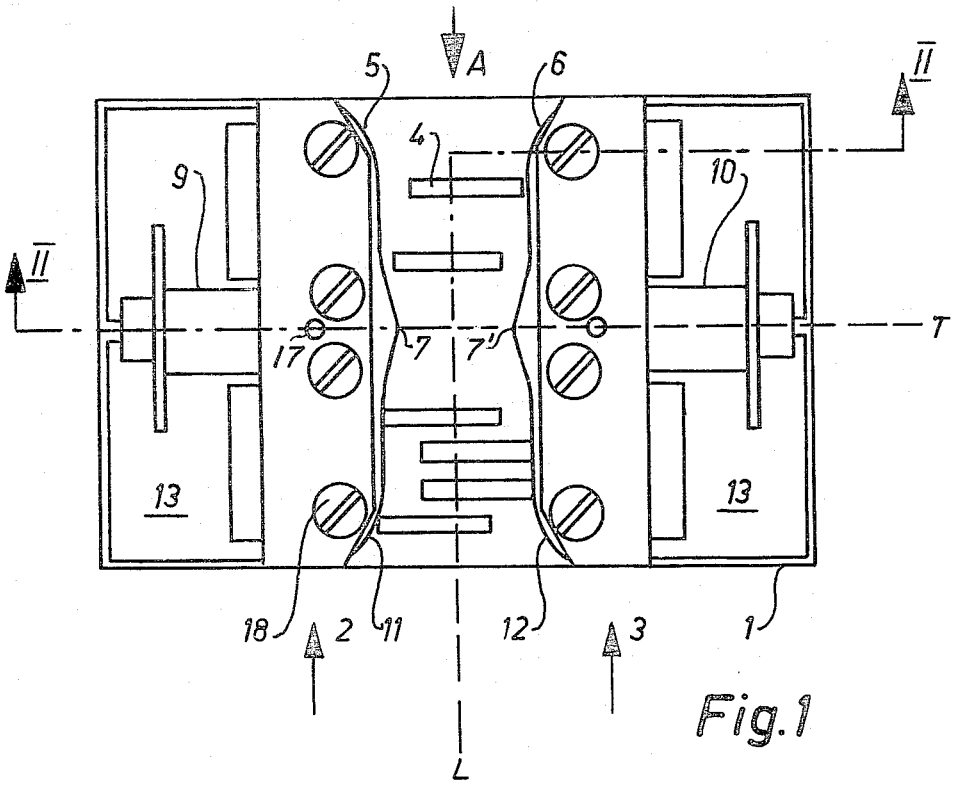
FIG. 1 is a plan view of a selection device in accordance with this invention.

The device illustrated in FIG. 1 has bed-plate 1 on which two identical selector stations 2, 3 are fitted to form the selective canal in which selectors 4 are moved. This device is operative to run in both directions. It may be considered that selectors 4 are moving relatively in relation to the device, in the direction shown by arrow A. The selective canal has a narrowing entry, bordered by sides 5, 6 and a selection point defined as the narrowest place in the canal, located between pole structures 7, 7′ of electromagnets 9, 10. The canal further has a widening outlet, bordered by the selection point and sides 11, 12.

Figure 2:
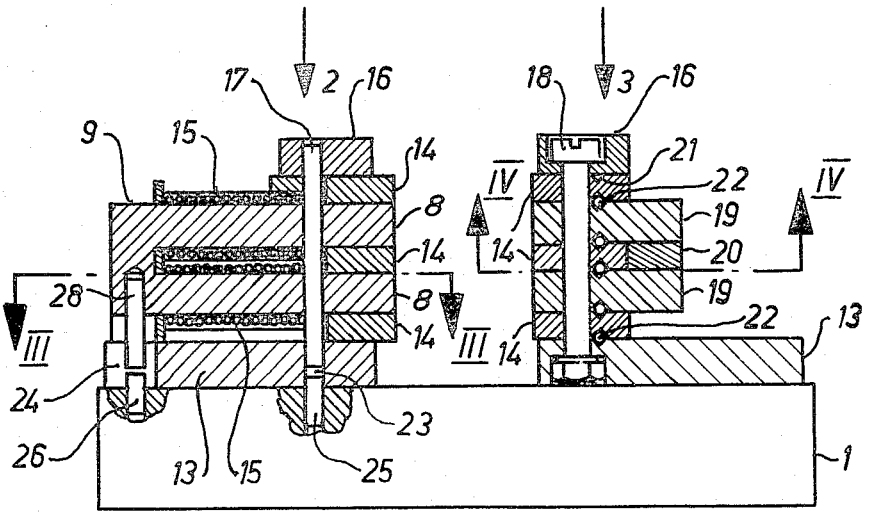
FIG. 2 is a section view according to II—II of FIG. 1.

FIG. 2 represents a section view of the selection device, according to lines II—II of FIG. 1.

The selector station 2 includes a base plate 13, strips 14 of hard non-magnetic metal, an electromagnet 9 with individual poles 8 and two semi-coils 15, and a cover 16. A single position pin 17 penetrates all of these parts which are secured to base plate 13 through fastening elements 18 (FIGS. 1, 2).

The selector station 3 also includes a base plate 13, strips 14 of hard non-magnetic metal, pole parts 19 made of good magnetic permeability, for instance, of soft steel, a permanent magnet 20 and a cover 16. All of these parts are provided with "V" grooves 21, running parallel to the moving direction of selectors 4 (arrow A). Deformable wire 22 is lodged in each space formed by two face-to-face grooves 21. The wire diameter is chosen to allow a deformation thereof within the clearance formed by the face-to-face grooves 21, while tightening the stacked parts. This deformation of wire 22 should guarantee sufficient self-alignment of the parts. Thus, the assembling operation is substantially facilitated and does not require careful advanced planning. Positioning and orienting of each selector station on bed-plate 1 is achieved through a hole 23 of base plate 13 in which positioning pin 17 is lodged, and through a groove 24.

A pin 25, integral and emerging from bed-plate 1 in hole 23, positions a selector station. A pin 26, also integral and emerging from bed-plate 1 in groove 24, orients a selector station around pin 25. This assembly substantially reduces the adjustment drawbacks of the distance between two selector stations and practically eliminates all adjustments on auxiliary gears.

Figure 3:
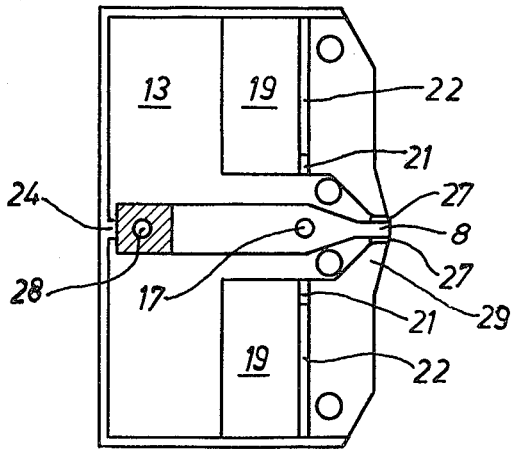
FIG. 3 is a section view according to III—III of FIG. 2.

Pole parts 19, represented in FIG. 3, are separated from selection pole 8 by filler 27 which gauges the minimal distance needed between pole part 19 and selection pole 8. The positioning of selection pole 8 in relation to base plate 13 is determined by positioning pin 17. The orientation of electromagnet 9 (FIGS. 1, 2), determined by the orientation of selection pole 8, is achieved by a pin 28, integral and emerging from selection pole 8, in groove 24 of base plate 13. Thermal dilation of electromagnet 9 should occur with no difficulty, by displacing pin 28 toward the outside of the selector station 2, that is, toward the left in FIGS. 2 and 3.

Nose 29 of pole part 19 is sized to allow constant saturation induction in each selector. Unavoidable residuary leakage flux of the magnetic adherence circuit, in the direction of the selective magnetic circuit, is short-circuited by the "U" monoblock core of electromagnet 9, in order to greatly reduce the impact of such leakage flux on the selector passing in front of the unexcited selection pole.

Figure 4:
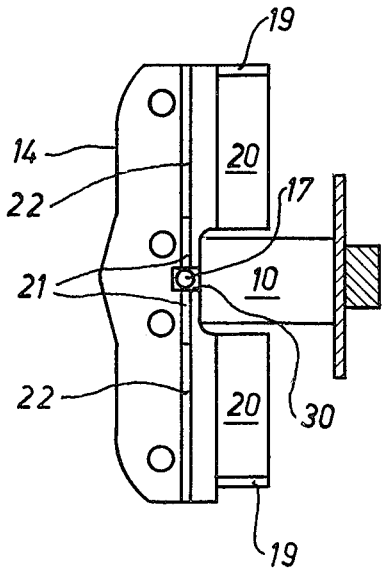
FIG. 4 is a partial section view according to IV—IV of FIG. 2.

In FIG. 4, hard metal strip 14 is shown with its clearance 30, allowing longitudinal positioning by positioning pin 17. Grooves 21 hold deformable wire 22, allowing orientation of strip 14 around the positioning pin in relation to pole parts 19 which, in the same manner, will be oriented themselves in relation to the part on which they are assembled. In the present embodiment, pole parts 19 are assembled on another strip 14. In the same manner, lower strip 14 will be oriented in relation to base plate 13.

Two permanent magnets 20 of rare earths are assigned to each selector station. These permanent magnets are illustrated in FIG. 4 as being located on each side of electromagnet 10. The advantageous location of the permanent magnets before the selection point, as viewed from the directional function of the device, allows the selectors to be stabilized before their arrival at the selection point, and improves their longevity. Thus, in a flat bed machine, a permanent magnet functions alternately as a stabilizer and as an amplifier of movement.

As may be seen from FIGS. 1 to 4, the selection device shown has selector stations 2 and 3 which are identical and also are geometrically and magnetically symmetrical with respect to a longitudinal first axis L of the selection canal, as shown in FIG. 1, and with respect to a transverse second axis T passing through the poles of pole structures 7, 7' of opposing electromagnets 9 and 10, respectively, also as shown in FIG. 1.

One advantage of the invention is the fact that, due to the similarity of parts and assembly of the selector stations, very significant savings are possible in the manufacturing, assembling and adjustment of the device. The adherence system has been improved magnetically by permanent magnets of rare earths, having on the average a magnetic energy four times greater than that of the best ferrites. Also, the improvement of the selective magnetic circuits, by locating two semi-coils instead of one on a monoblock core with a small gap, combine to result in a truly symmetrical bi-directional device. Furthermore, a reduction in selfresistance, obtained by reducing the number of turns of the coils, coupled with improvements in the magnetic adherence circuits, and the selective magnetic circuit, allow a quicker rise of current and, therefore, a higher responsive speed. Consequently, the running frequency of the device is higher.

While the present invention has been particularly shown and described with reference to a preferred embodiment, various changes and modifications may be made without departing from the spirit and scope of the invention. It is intended that the appended claims be interpreted as including all such changes and modifications.

What is claimed is:

1. An electromagnetic selection device for needles of a knitting machine, comprising selector means relatively movable in a selection canal in a longitudinal direction thereof and shiftable in said canal in a transverse direction thereof, said selection canal having two outer portions forming, in said longitudinal direction of said canal, a narrowing entry and a widening outlet, respectively, for said selector means, and an inner portion comprising electromagnetic selection means for shifting said selector means transversely of said longitudinal direction toward one or the other side of said selection canal during relative movement of said selector means through said selection canal, said selection device comprising two substantially identical and symmetrical selector stations operative to enable the selection of said selector means, independently from the longitudinal relative movement of the selector means in said selection canal, each selector station including one of two opposing electromagnets having poles disposed adjacent said selection canal in said inner portion thereof, said selector stations each including a magnetic adherence system in each of said outer portions of said selection canal for stabilizing said selector means before their arrival at said poles of said electromagnets, independently of the direction of relative movement of said selector means in said selection canal, and for amplifying said shifting of said selector means after their passage at said poles of said electromagnets, independently of the direction of relative movement of said selector means in said selection canal, each said selector station being formed of stacked parts, oriented in relation to each other by deformable wires lodged in spaces formed by face-to-face grooves of different parts, and each said selector station having a single positioning pin defining the position of said stacked parts of a said selector station in relation to each other and an orientation pin defining the orientation of said stacked parts of a said selector station about said positioning pin, said orientation pin being displaceably positioned in a groove such that thermal dilation of said electromagnet displaces said orientation pin in said groove in a direction transverse to said wires lodged in said spaces formed by said face-to-face grooves.

2. The device according to claim 1, further comprising a common bed-plate, and two integral elements emerging from said common stand in openings to orient and position the parts of each selector station with respect to said bed-plate.

3. The device according to claim 2, wherein at least one integral element is a pin.

4. The device according to claim 1, wherein said selector stations are geometrically and magnetically symmetrical with respect to a longitudinal first axis of said selection canal, and with respect to a transverse second axis passing through said two opposing electromagnets.

5. The device according to claim 1, wherein each of said selector stations includes permanent magnet means disposed adjacent said selection canal and on either side of said pole of said electromagnet of said selector station.

* * * * *